United States Patent [19]

Alaurent

[11] Patent Number: 5,011,030

[45] Date of Patent: Apr. 30, 1991

[54] FASTENING MEMBER FOR A CURTAIN TELESCOPIC ROD

[76] Inventor: Jacques Alaurent, 14 rue Villebois-Mareuil, Cormeilles-en-Parisis, France, 95240

[21] Appl. No.: 430,604

[22] Filed: Nov. 2, 1989

Related U.S. Application Data

[63] Continuation-in-part of Ser. No. 309,764, May 5, 1988, abandoned.

[30] Foreign Application Priority Data

May 6, 1987 [FR] France ..... 87 06396

[51] Int. Cl.[5] ..... A47H 1/00

[52] U.S. Cl. ..... 211/105.6; 211/123; 248/264

[58] Field of Search ..... 211/105.6, 105.1, 105.5, 211/123, 180; 248/264, 268

[56] References Cited

U.S. PATENT DOCUMENTS

| | | |
|---|---|---|
| 698,223 | 4/1902 | Prideaux . |
| 833,557 | 10/1906 | Snyder et al. . |
| 943,151 | 12/1909 | Marceau . |
| 961,352 | 6/1910 | Walters . |
| 1,405,958 | 2/1922 | Wolff . |
| 1,414,289 | 4/1922 | Kubiak . |
| 1,500,049 | 7/1924 | Brooks . |
| 1,528,981 | 3/1925 | Miller . |
| 1,639,551 | 8/1927 | Booth . |
| 2,225,281 | 12/1940 | Speranza . |
| 2,399,001 | 4/1946 | Chilton . |
| 2,545,251 | 3/1951 | Barettella . |
| 2,636,617 | 4/1953 | Franz . |
| 3,506,135 | 4/1970 | Klingaman . |

FOREIGN PATENT DOCUMENTS

| | | |
|---|---|---|
| 800088 | 7/1949 | Fed. Rep. of Germany . |
| 406134 | 8/1909 | France . |
| 272203 | 3/1951 | Switzerland . |

*Primary Examiner*—Sarah A. Lechok

*Attorney, Agent, or Firm*—Wenderoth, Lind & Ponack

[57] ABSTRACT

A fastening member for a telescopic rod having an internal spring and intended to support a curtain on a pane frame or a door, said door is adapted to be mounted on an end portion of the telescopic rod. The member has a first flat portion extending towards the window and is provided at its end with a fixation area for the pane frame, a second flat portion extending from the first portion in a direction substantially perpendicular to the first portion having at its lower end a support area located below the fixation area when in use adapted to bear on the pane frame, and a third flat section extending from the second flat section upwards and in a direction parallel to the first flat section. The third section is sized so that, when the fastening member is in use, its upper end portion, adapted to fit on the rod end portion, is located at a level higher than the level of the fixation area of the first section. The third section is laterally located beyond the vertical pane edge.

7 Claims, 1 Drawing Sheet

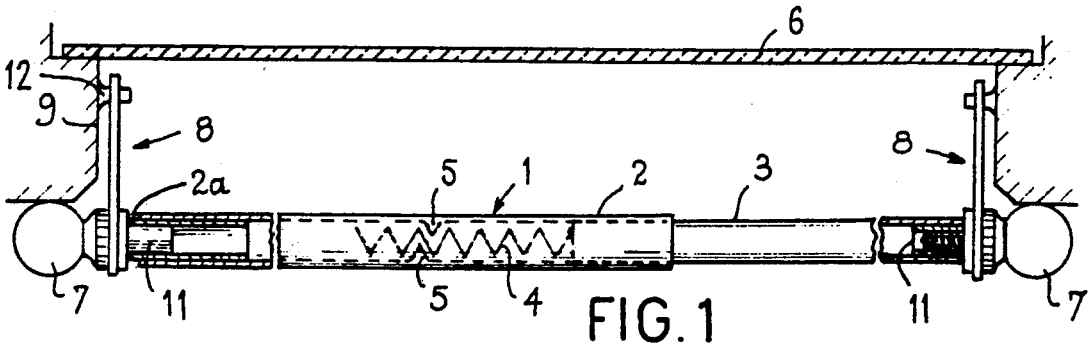
FIG. 1
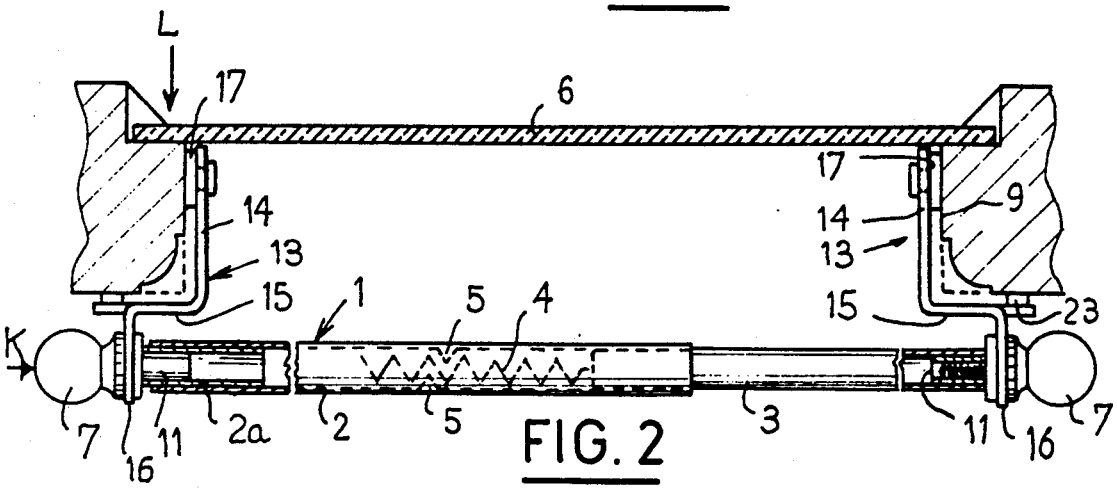
FIG. 2
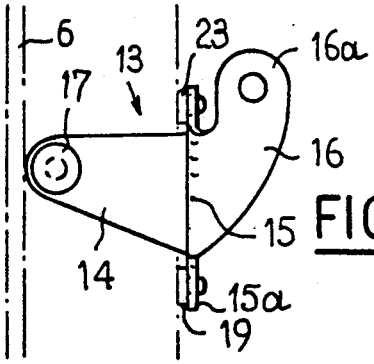
FIG.3
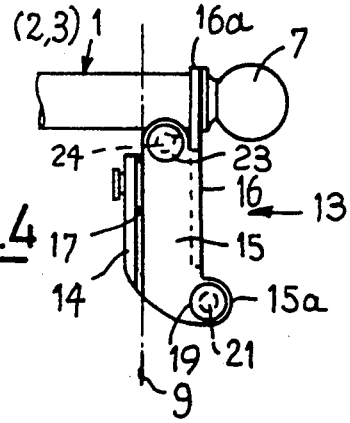
FIG.4
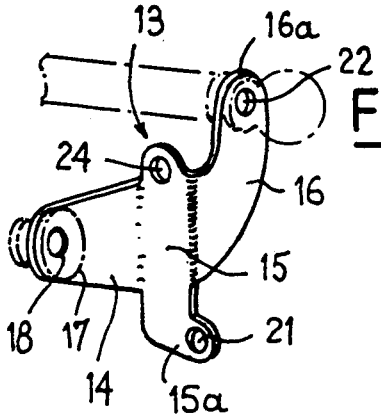
FIG.5
FIG.6
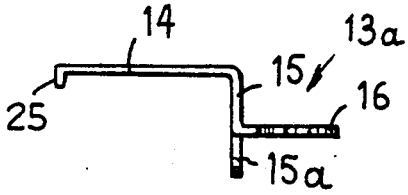

FASTENING MEMBER FOR A CURTAIN TELESCOPIC ROD

BACKGROUND OF THE INVENTION

The present application is a Continuation-in-Part application Ser. No. 07/309,764, filed May 5, 1988 now abandoned.

The present invention relates to a fastening member for a telescopic rod of the kind having an internal spring and intended to support a curtain on a window frame or a door.

These rods are generally formed with two tubular members telescopically mounted and in which a spring pushes each end portion away from each other on the support frame of the window. The rods of this kind known until now are not satisfactory, for different reasons: on the one hand, the anchoring is defective on hard supports (metal or plastics), and on the other hand, the rod usually cannot be mounted at a suitable gap from a window pane to avoid effects of condensation on the curtains. Also, such rods do not permit the curtain to completely cover the pane.

Thus the U.S. Pat. No. 698,223 to BRIDEAUX discloses a sash curtain rod provided at its end portions with terminal tips adapted to be anchored along the edge of wooden frames. The tips must be sufficiently pushed into the wood, which is therefore damaged on a visible portion of the window.

On the other hand, these known fastening members are especially adapted for sash windows and are not usable on all kinds of windows, in particular metal or plastics windows. Another shortcoming of these known fastening members is that they are not provided with any supporting means to maintain the rod and its curtain at a suitable distance from the window pane, to avoid dirty marks due to moisture condensation. Lastly the known fastening members cannot be mounted so that the curtain covers the window pane without any gap on its rule periphery, in particular along its upper and lower sides.

The U.S. Pat. No. 833,557 to SNYDER discloses an attaching curtain fixture which has the same shortcomings as the preceding patent. However in this second device, the fixation means includes two tips for each end portion of the rod. The pressure must therefore be well shared out between both tips, even if the surface states on the window chassis are not identical, and imperfect. In practice, this is not always easy to obtain.

SUMMARY OF THE INVENTION

The object of the present invention is to propose a fastening member and a corresponding telescopic rod device in which the above shortcomings are avoided.

According to the invention, the fastening member, adapted to be mounted on an end portion of the telescopic rod, has a fixation anti-slip element adapted to be applied on the pane frame in the vicinity of the window pane, and is shaped so that in use, the adjacent end portion of the rod is applied by gravity on the window pane and prevents the rod and fastening member from tilting.

The anti-slip element is a rubber-like material plug or a sucker-shaped plug.

According to another improved embodiment of the invention, the fastening member has a first flat portion extending towards the pane and is provided at its end with a fixation area on the pane frame, a second flat portion extending from the first portion in a direction substantially perpendicular to the first portion and provided at least at its lower end with one support area located below the fixation means when it is in use and adapted to bear on the window frame. A third flat section extends from the second flat section upwards and in a direction parallel to the first flat section, the third section being sized so that, when the fastening member is in use, its upper end portion, adapted to fit on the rod end portion, is located at a level higher than the level of the fixation means of the first flat section. The third section is laterally located beyond the vertical pane edge.

With such an arrangement of the fastening member, it is possible to maintain the rod and therefore the curtain sufficiently far from the window pane, and at the same time to position the rod at a level sufficiently high above the upper edge of the window pane, so that the rod cannot be seen from the outside. The same obviously applies to a rod possibly mounted at the lower edge of a window pane, so that the curtain completely covers the whole periphery of the window pane. In this case, the orientation of the fastening member is reversed and if the curtain is tightened, the rod is biased upwards by the curtain tension.

Other features and advantages of the invention will appear from the following description of three embodiments.

DESCRIPTION OF THE DRAWING

In the drawings:

FIG. 1 is a plan view of a telescopic rod mounted on a pane chassis provided at its ends with fastening members according to a first embodiment of the invention;

FIG. 2 is a plan view of a second embodiment of the fastening member and telescopic rod according to the invention, mounted on a pane chassis;

FIG. 3 is a side view of the fastening member according to arrow K of FIG. 2,

FIG. 4 is a side view of the fastening member, and of the rod from the side of the window pane, according to arrow L of FIG. 2;

FIG. 5 is a perspective view off one of the fastening members seen in FIGS. 2 to 4;

FIG. 6 is a plan view of a third embodiment of the fastening member illustrated in FIG. 5.

A rod 1 shown in FIG. 1 includes two tubular members 2 and 3 of different diameters, the tubular members 3 having a diameter less than tubular member 2 and being slidingly mounted within the latter. An internal spring 4 is placed within tubes 2 and 3, and by one of the end portions is attached to the end of tube 3. The opposite end of spring 4 is retained by internal bosses 5 of tube 2 through which spring 4 can be screwed. Thus the rotation of one of tubular members 2 and 3 relative to the other permits one to adapt the length of the telescopic rod 1 to the width of the window pane 6. The opposite ends of tubes 2 and 3 can be formed by balls 7.

At its opposite ends the rod 1 is provided with two rigid fastening members 8 adapted to be fixed on the window chassis 9. The fastening members 8 are mounted on the ends of rod 1 by any suitable means permitting insertion of the rod into the curtain hem without being disturbed by the fastening members 8.

For example, as illustrated, one end of rod 1 a ferrule 11 is fixed within the end of tube 3, and member 8 is fastened on ferrule 11 by means of a screw fixed to the end ball 7 and screwed within ferrule 11.

The opposite fastening member 8 is similary fixed to a tube portion 2a extending inside tube 2, from which it can be easily separated with its corresponding fastening member 8 to permit mounting or removing the curtain from the rod 1.

Each fastening member 8 is provided at its end opposite to rod 1 with a fixation anti-slip element 12 adapted to be applied on the window frame 9 in the vicinityy of the pane 6. This element 12 can be a rubber-like material plug, or a sucker-shaped plug, and remains attached by friction on the surface of frame 9. The element 12 is attached to the end of member 8 by any suitable manner, for example by passing through a terminal opening in the end of member 8.

Each member 8 is shaped so that the adjacent end portion of rod 1, formed here by the ball 7, is applied by gravity on the frame 9 and therefore prevents the rod 1 and members 8 from tilting downwards.

The length of fastening members 8, which are oriented perpendicularly to the window pane 6, is such that the fixation areas of elements 12 are very close to the pane 6, but also that the rod 1 is sufficiently far from the window pane 6 in order to avoid the formation of any dirty marks on the curtain due to the effect of moisture condensation.

The second embodiment of the fastening member according to the invention is illustrated in FIG. 2 to 5 and will be now described.

A fastening member 13 is rigid and has a first flat portion 14 extending towards the window pane 6 when member 13 is mounted on frame 9, a second flat portion 15 extending from the first portion 14 in a direction or plane substantially perpendicular to the first portion 14, and a third flat section 16 extending from the second flat section 15 upwards when in use, and in a direction parallel to the first flat section 14.

The end of the first section 14 is provided with a fixation means for frame 9, for example an anti-slip friction member or ball 17 adapted to fit within a retaining opening 18 of the end of the first section 14. On the other hand, the second section 15 is provided with one support area located below the level of the fixation means 17 when member 13 is mounted on frame 9, and is adapted to bear on frame 9. This support area may be formed by an anti-slipping member 19 similar to member 17 and inserted into a corresponding opening 21 designed in an end portion 15a of section 15, curved in a direction perpendicular to first section 14 and towards the frame 9. This permits the anti-slipping member 19 to effectively bear on a supporting surface of frame 9.

The second flat section 15 can also be provided with an upper support area on frame 9, ensured for example by an anti-slip friction member 23 partially inserted in an opening 24 of the upper end of second section 15.

The third section 16 extends upwards and is sized so that, when the member 13 is in use, its upper end portion 16a, adapted to fit on the rod end portion by means of an opening 22, is located at a level higher than the level of the fixation means 17 of the first section 14, as clearly seen in FIGS. 3 and 4. Moreover, the third section 16 is laterally located, or offset, beyond the vertical pane edge intersecting the surface of frame 9 perpendicular to pane 6.

One of members 13 is attached to a short tube 2a fitted into tube 2 as in the first embodiment.

Of course, the length of the first section 14 is in close relationship with the thickness of the frame 9. The friction contact area of member 17 is very small in order to permit the location of this fixation means very close to the window pane 6 and close to the corner to obtain a high pressure ratio.

The advantages of the fastening members 13 are the following.

The length of first section 14 permits the maintenance of the rod 1 and its curtain sufficiently far from the window pane 6 to avoid dirty marks caused by moisture condensation.

The lower bearing area on frame 9 at the end of the section 15, formed by element 19, below the level of the fixation means 17, prevents the rod 1 and curtains from tilting downwards by effect of gravity.

It will be noticed that the support areas provided at the opposite ends of the second section 15 are located beyond the edge of frame 9, in order to avoid rounded edges that are often formed on wooden window frames.

The upper support area provided by element 23 limits the upwards tilting movements of the rod 1 and member 13.

The fact that member 13 comprises a third section 16 located in a vertical plane offset towards the frame 9 with regard to first section 14 and extending upwards to a suitable level has two advantages: it permits mounting the rod 1 at a level sufficiently higher than the level of the fixation point 17 to hide the rod 1 from the outside, behind the window frame. The vertical sides of the frame 9 can be completely covered by the curtain and the section 16 cannot be seen from the outside. Thus due to the particular features of member 13, the window pane 6 can be completely covered by the curtain as well on its vertical sides as along its horizontal upper and lower sides.

Due to the bearing surface of element 19 on the frame 9, the extracting effect of gravity on fixation means 17 is lowered, which improves the stability of the fastening member 13 and the rod.

The friction anti-slip element 17 avoids damage to the frame 9, and is efficient on a wooden frame as well as on plastic or metal frames.

However, according to another embodiment 13a (FIG. 6) of member 13, the friction fixation means 17 is changed to an end tip 25. This tip 25 is adapted to be inserted into the gap that is always provided between the glass pane 6 and the frame 9. Thus this embodiment is convenient for some windows which cannot receive a friction fixation means, and allows an efficient anchoring without any important damage on the frame and in a little visible area.

It should be noted that the width of the second section 15 can be increased in order to provide a lower support area, without any lower extension such as 15a. The fixation and bearing areas of the fastening member, provided by balls, can be changed to a rubber sheet covering the surface of the fastening member oriented towards the pane and its frame.

What is claimed is:

1. A fastening member for a telescopic rod having an internal spring for supporting a curtain on a window frame or door frame, said fastening member being adapted to be mounted to an end portion of the telescopic rod, and said fastening member comprising:

a first flat section extending in a first direction having a fixation portion at an end thereof for fixation to the frame;

a second flat section extending from said first flat section in a second direction substantially perpendicular to said first direction, said second flat section having a lower end, and said second flat section having at least at said lower end a support area, located below said fixation portion of said first flat section in use, said support area being adapted to bear on the frame; and a third flat section extending from said second flat section upwardly therefrom in use and in a third direction parallel to said first flat section, said third section having an upper end portion thereof adapted to fit on the end portion of the telescopic rod which in use is located at a level higher than the level of said fixation portion of said first flat section, and said third section being laterally offset on said second flat section with respect to said first flat section such that said third flat section, when in use on a window frame, will be laterally located beyong the vertical edge of the window pane.

2. The fastening member as set forth in claim 1, wherein said second flat section has a further support area at the upper end thereof, said support areas at said upper and lower ends of said second flat section preventing, in use, any upwards and downwards tilting, respectively, of said fastening member and the telescopic rod.

3. The fastening member according to claim 1 wherein said fixation portion comprises an anti-slip friction member.

4. The fastening member according to claim 1, wherein said fixation portion comprises an end tip.

5. The fastening member according to claim 1, wherein said second intermediate flat section has a lower end portion which extends in a plane perpendicular to and away from said first flat section and comprises said support area.

6. The fastening member according to claim 1, wherein said first flat section extends a predetermined distance away from the plane of said second flat section, said distance being chosen to be substantially equivalent to the thickness of a frame.

7. A telescopic rod device having an internal spring and a fastening member at each end thereof for supporting a curtain on a window pane frame, each said fastening member comprising:

a first flat section extending in a first direction having a fixation portion at an end thereof for fixation to the frame;

a second flat section extending from said first flat section in a second direction substantially perpendicular to said first direction, said second flat section having a lower end, and said second flat section having at least at said lower end a support area, located below said fixation portion of said first flat section in use, said support area being adapted to bear on the frame; and a third flat section extending from said second flat section upwardly therefrom in use and in a third direction parallel to said first flat section, said third section having an upper end portion thereof adapted to fit on the end portion of the telescopic rod which in use is located at a level higher than the level of said fixation portion of said first flat section, and said third section being laterally offset on said second flat section with respect to said first flat section such that said third flat section, when in use on a window frame, will be laterally located beyond the vertical edge of the window pane.

* * * * *